US009359820B2

(12) United States Patent
Markley et al.

(10) Patent No.: US 9,359,820 B2
(45) Date of Patent: Jun. 7, 2016

(54) NON-SLIP LADDER BASE DEVICE

(71) Applicants: Martin J. Markley, Lenexa, KS (US); Joseph J. Losito, Olathe, KS (US)

(72) Inventors: Martin J. Markley, Lenexa, KS (US); Joseph J. Losito, Olathe, KS (US)

( * ) Notice: Subject to any disclaimer, the term of this patent is extended or adjusted under 35 U.S.C. 154(b) by 28 days.

(21) Appl. No.: 14/840,104

(22) Filed: Aug. 31, 2015

(65) Prior Publication Data

US 2015/0376947 A1 Dec. 31, 2015

Related U.S. Application Data

(63) Continuation-in-part of application No. 14/171,363, filed on Feb. 3, 2014.

(51) Int. Cl.
*E06C 7/46* (2006.01)

(52) U.S. Cl.
CPC ..... *E06C 7/46* (2013.01)

(58) Field of Classification Search
CPC ..... E06C 7/46
See application file for complete search history.

(56) References Cited

U.S. PATENT DOCUMENTS

| | | | | | |
|---|---|---|---|---|---|
| 1,909,620 | A * | 5/1933 | Lang | E06C 7/46 | 182/110 |
| 1,973,226 | A * | 9/1934 | Rose | E06C 7/46 | 182/109 |
| 2,623,679 | A * | 12/1952 | Agombar | E06C 7/46 | 182/109 |
| 4,415,062 | A * | 11/1983 | Shaw | E06C 7/46 | 182/109 |
| 5,279,387 | A * | 1/1994 | Swiderski | E06C 1/32 | 182/108 |
| 5,370,203 | A * | 12/1994 | Kiska | E06C 7/46 | 182/109 |
| 7,073,821 | B2 * | 7/2006 | Lagsdin | B60S 9/02 | 248/633 |
| 7,172,216 | B1 * | 2/2007 | Lagsdin | B60S 9/02 | 280/763.1 |
| 7,401,812 | B2 * | 7/2008 | Lagsdin | E02F 9/085 | 248/188.8 |
| 2006/0124393 | A1 * | 6/2006 | Robinson | E06C 7/46 | 182/107 |
| 2009/0200110 | A1 * | 8/2009 | Esselborn | E06C 7/46 | 182/107 |
| 2012/0199416 | A1 * | 8/2012 | Hopkins | E06C 7/46 | 182/111 |
| 2014/0311826 | A1 * | 10/2014 | Beardman | E06C 7/46 | 182/107 |

FOREIGN PATENT DOCUMENTS

| | | | | | |
|---|---|---|---|---|---|
| DE | 337341 | C * | 5/1921 | E06C 7/44 | |
| DE | 460446 | C * | 5/1928 | E06C 7/46 | |
| DE | 102006036706 | A1 * | 9/2007 | E06C 7/46 | |
| GB | 190917499 | A * | 0/1910 | E06C 7/46 | |
| GB | 411980 | A * | 6/1934 | E06C 1/20 | |
| GB | 2435489 | A * | 8/2007 | E06C 7/46 | |

* cited by examiner

*Primary Examiner* — Charles A Fox
*Assistant Examiner* — Kristine Florio
(74) *Attorney, Agent, or Firm* — Invention Protection Associates, LLC

(57) ABSTRACT

A ladder base device having a base platform and a pair of socket-like receptacles for receiving the ends of a pair of ladder rails. The receptacles are pivotally attached to the platform and the platform is reversible with different surfaces for frictional engagement with different types of ground or floor surfaces on each side.

8 Claims, 4 Drawing Sheets

NON-SLIP LADDER BASE DEVICE

This application is a continuation-in-part that claims the benefit of non-provisional application Ser. No. 14/171,363. Furthermore, application Ser. No. 14/171,363 is hereby incorporated by reference.

BACKGROUND

The present invention generally relates to ladder accessories, and it is specifically directed to devices for easily mounting to the lower ends of the rails of a rigid ladder in order to prevent the ladder from sliding along any of a variety of types of ground surfaces and making the ladder unstable while it is leaning against a vertically extending support structure and its rungs are bearing the weight of a user.

There are a variety of devices, in the prior art, designed to better anchor a rigid ladder to the ground and prevent the lower end of a ladder from sliding along the ground while in use. These prior art non-slip devices generally fall within two categories that are distinguishable from one another by how the devices are to be attached to ladder rails. In one such category are non-slip devices that are to be securely attached to ladder rails by use of a mechanical fastener pin, screw, nut & bolt, etc.), and in the other category are non-slip devices to which ladders can be safely mounted by virtue of gravity and/or friction fitting.

One example falling within the first category is found in U.S. Patent Application Publication No. 2012/0199416 to Hopkins et al. Hopkins discloses a ladder stabilizing apparatus that principally features a base plate having an attached horizontal shaft that is elevated from the base plate. Ladder leg retainers are pivotally attached to that shaft by rotary bearing, and these leg retainers are each described as being an adjustable channel that forms a three-sided clamp that is locked into place around a ladder rail by a releasable fastener such as a bolt and wingnut assembly. The pivotability of the Hopkins leg retainers accommodates a range of ladder lean angles that a user might prefer, but the configuration of the apparatus ostensibly prevents the base plate from rotating more than 90 degrees when the apparatus is attached to a ladder. Thus, the base plate has definitive top and bottom surfaces, where only the bottom surface engages the ground. Notwithstanding the suggestion that an automobile be placed upon a portion of the base plate in order to anchor it to the ground, it is suggested that the bottom surface could be a friction-enhancing or non-slip surface and is further suggested that the base plate may feature apertures through which stakes or nails could be inserted in order to fasten the apparatus directly to the ground or other support surface.

One consequence of the aforementioned inability to completely invert the Hopkins base plate is that only one of its faces can function as a ground-touching surface. So, unless removable surfaces can be attached to that bottom face, it will always have the same topography and friction characteristics—which, invariably, will not be optimum for every conceivable ground or floor surface that a ladder may be used upon. Furthermore, even if extraneous surfaces can be removably attached to the bottom face of the base plate, the act of installing and substituting them can be tedious. It may be similarly tedious to have to insert spikes through holes within the base plate, for example, to provide the type of slide prevention that the base plate, alone, might experience if its bottom face was a spiked surface. Of course, these deficiencies exist for any base surface that is one-sided, in terms of its ground engagement function, because one particular surface topography and material will not be effective in preventing slippage along every ground and floor surface. Therefore, a ladder attachment that features multiple ground-engaging surfaces that have distinct topographies and are easily reversible may be more desirable.

To wit, as another example of a slip-inhibiting apparatus that is attached to the base of a ladder using mechanical fastening means, U.S. Pat. No. 2,623,679 to Agombar discloses a non-slip ladder base that features a pair of non-slip members that are each to be bolted to a ladder rail. Each such Agombar non-slip member is pivotable between positions in which either a single spike is downward facing to engage the ground or a frictional shoe is downward facing to do so. This configuration enables a user to select a ground engagement surface that is more effective in prevent sliding along the attendant ground surface. Furthermore, the two non-slip members are rigidly connected together by a transverse tube so that they pivot in unison. This eliminates the type of instability that might otherwise be experienced if the non-slip members were able to move independently while they are each affixed to a ladder rail.

A drawback of the Agombar assembly, however, is that its configuration necessarily limits the functional surface sizes of the alternative spiked and frictional surfaces. More specifically, the assembly configuration is such that, if the respective ground engagement surface areas of the non-slip members were expansive in longitudinal dimensions (i.e., in directions transverse to the direction of ladder rungs), the non-slip members might be unable to pivot between the two ground engagement surfaces being in their opposing down positions (due to the ladder interfering with the pivot path of the surfaces). And if those ground engagement surface areas were laterally expansive enough to cover a swath of ground space extending the entire distance between the ladder rails, the upward facing surfaces (those not in the ground-engaging position at a given moment) might obstruct the user's foot access to the lowest one or two ladder rungs and, thereby, pose a significant use hazard. Similar configuration-imposed size limitations on ground engagement surfaces are characteristic of other prior art non-slip attachments that are to be mechanically fastened to a ladder and are pivotable between alternate ground engagement surfaces.

Consequently, it may be desirable to employ a ladder slip-inhibiting apparatus that is not to be mechanically fastened to the ladder and, instead, features a base element that can be freely pivoted or flipped between different types of ground engagements. Such an apparatus is found in U.S. Patent Application Publication No. 2009/0200110 to Esselborn. More specifically, Esselborn discloses a generally planar anti-slip platform that has abutments—either in the form of recesses within a face of the platform or in the form of protrusions extending up from the face of the platform—which the ends of ladder rails will press against and will, thereby, prevent the ladder from sliding horizontally along the platform. Furthermore, in at least one embodiment, the Esselborn platform features different types of anti-slip surfaces along its opposing faces so that type of platform surface most suitable for preventing sliding along a particular ground or floor surface can be faced down in ground-contacting position.

Nevertheless, while the Esselborn apparatus provides multiple slip-inhibiting surfaces that are reversible without having to manipulate any mechanical fasteners, and while its configuration and engagement with a ladder in no way limits the functional surface area of the ground-engaging platform, it may still be deemed an inadequate solution for some. For example, if a user first positions one side of the platform on bottom, only to determine that its opposite side might be better suited to grip the attendant ground surface, the user will have to lift the ladder from the platform, turn over the platform and remount the ladder atop it. Typically, that sequence will require either (a) two persons (one person to lift and suspend the ladder while the other person flips over the platform) or (b) lifting the ladder, setting it down off of the platform, flipping over the platform and then re-placing the ladder back atop turned platform.

Consequently, the present inventors appreciate a need for a slip-inhibiting ladder base device that both (a) features two separate ground engaging surfaces and (b) allows a user to toggle between those two surfaces being in engagement with the ground or floor surface without the steps of mechanically unfastening and refastening the base device to the ladder or the steps of dismounting the ladder from and remounting the ladder to the base device. The present invention for a ladder base device substantially fulfills these needs.

SUMMARY

Typically, when using a ladder, a user will lean it against a vertical support (e.g., the side of a dwelling) by resting the respective upper ends of the ladder's legs (or "rails") against the vertical support while their lower ends rest atop the ground. The horizontally oriented steps (or "rungs") that connect the rails directly support the weight of a ladder-climbing user. Because of the importance of the ladder remaining stable while it supports a user, the lower ends (or "terminal ends") of the rails are often capped with rubber "ladder shoes" that are intended to inhibit the rails, which are often fabricated of aluminum, from inadvertently sliding along a floor surface that may not be highly frictional. It is well known that friction is the force resisting the relative motion of solid surfaces, fluid layers, and material elements from sliding against each other. Dry friction, specifically, resists relative lateral motion of two solid surfaces in contact, and the greater the friction between the terminal end of the ladder, the more likely it is that the ladder will remain stable during use. However, since the same ladder may be used indoors or outdoors and on a plethora of different types of ground and floor surfaces that may have vastly different frictional effects on the metal or rubber ends of the ladder, a cap-like ladder shoe certainly may not produce adequate stability in all cases, and prior art base devices may not as well.

Therefore, it is an object of the present invention to provide a ladder base device that, by the breadth of its ground platform, may improve the stability, in horizontal dimensions, of a ladder mounted to it. In one aspect of the invention, the present base device features a planar platform element that can be of virtually infinite width in the direction of ladder rung orientation and of considerable width in the perpendicular direction. Although the platform is generally rectangular, it can be pivoted 180 degrees to reverse the orientation of its faces, while a ladder remains mounted onto the base device. This is enabled by the presence of deep inlets formed within the platform and extending from one edge of the platform to just past its lateral centerline. More specifically, these inlets permit the platform rotation to occur without being obstructed by the ladder rails. Consequently, all that limits the longitudinal width of the platform is the height of the lowest ladder rung. The ground-contacting surface area of the platform element of the present device, which far exceeds that of any conventional, cap-like ladder shoe, provides good dimensional stability while the ladder is supporting a user. Providing further such stability is the texture and topography of that functional surface area.

In fact, it is another object of the present invention to not only prevent the base of a ladder from sliding along the ground, inadvertently, while the ladder is supporting a user, but to also be adapted to grip and prevent sliding along a variety of different ground and floor surfaces. In another aspect of the invention, the opposing faces of the planar platform have different types of surfaces which are each designed to create friction when mated against different ground surfaces. For example, one face may be fabricated of rubber and have a pattern that inhibits sliding along a hardwood surface, while the opposing surface may be spiked, and even fabricated of a different material, to prevent sliding along a grass or dirt ground surface.

Finally, it is another object of the present invention to provide a ladder base device that attaches to a ladder without the use of any mechanical fasteners and features a base platform that is rotatable, from one side to another, while the device remains attached to a ladder. As previously mentioned, the base platform has a pair of inlets formed within in it that permit such rotation without obstruction by ladder rails. Furthermore, in another aspect of the invention, two cap-like receptacles that ladder rails insert into are pivotably mounted to the platform within these inlets. In most cases, the receptacles will form a frictional plug fit around the bare, lower ends of the ladder rails. In such cases, the ladder can be lifted from the ground and the base device will remain attached. In other cases where these rail-receiving receptacles do not frictionally fit onto particular ladder rails, the platform can be simply flipped over without lifting the ladder or the receptacles, and gravity will allow the ladder rails to remain nestled within the receptacles. In any event, there need not be any intervening steps of unfastening and refastening the present device to a ladder when reversing the orientation of its base platform.

DETAILED DESCRIPTION OF THE PREFERRED EMBODIMENTS

Figure 1:
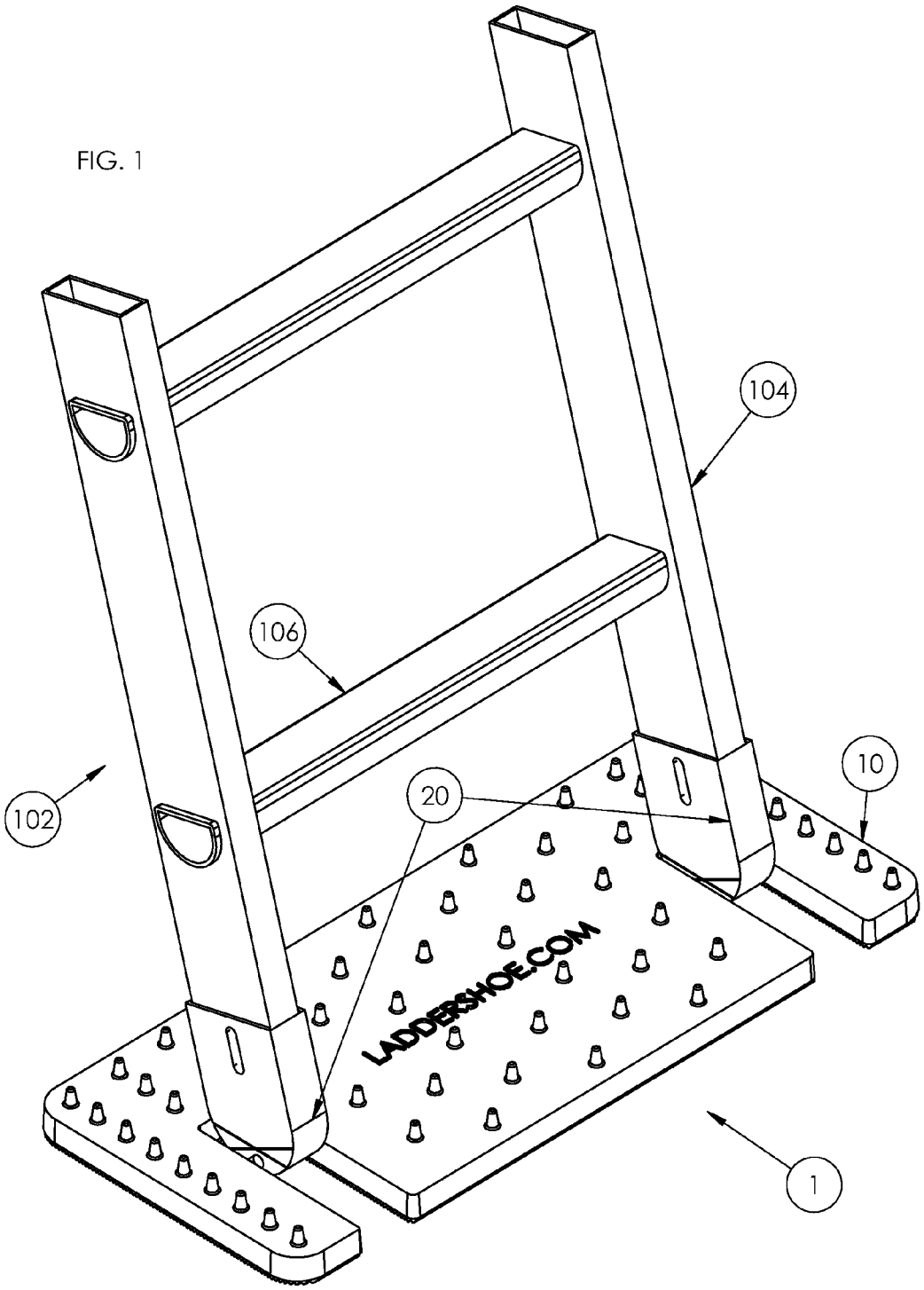
FIG. 1 is a top perspective view of a ladder base device in accordance with the present disclosure, the device being shown with a rigid ladder mounted to it.
Figure 2A:
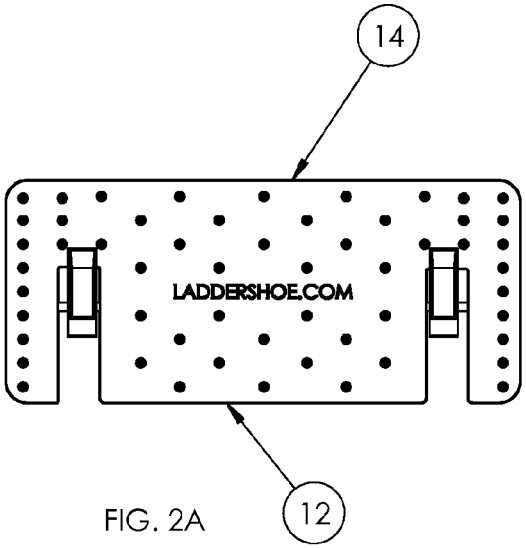
FIG. 2A is a top plan view of the ladder base device of FIG. 1.
Figure 2B:
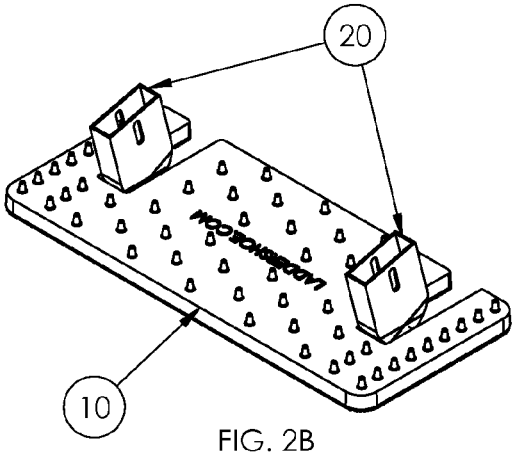
FIG. 2B is as top perspective view of the same.
Figure 2C:
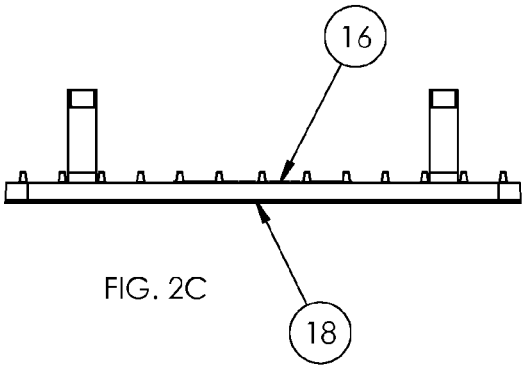
FIG. 2C is as front elevational view of the same.
Figure 2D:
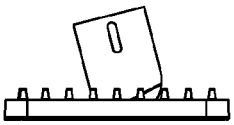
FIG. 2D is as side elevational view of the same.
Figure 3:
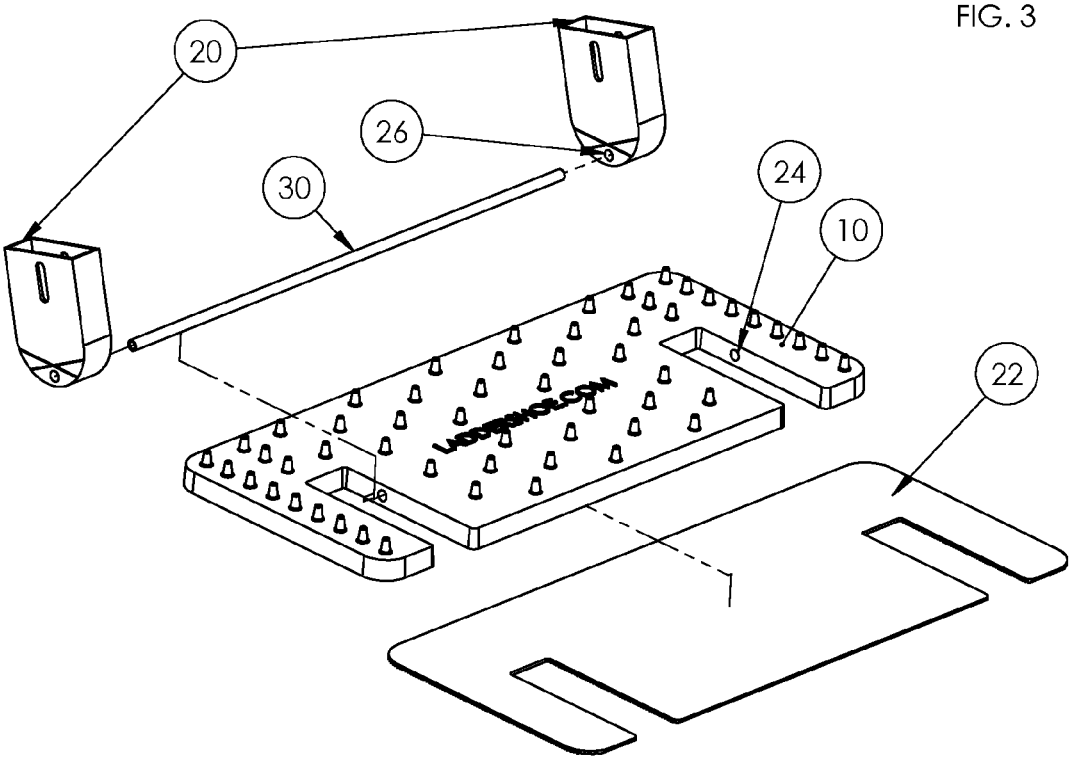
FIG. 3 is a top perspective view of a ladder base device in accordance with the present disclosure, the device being shown in a disassembled state.
Figure 4:
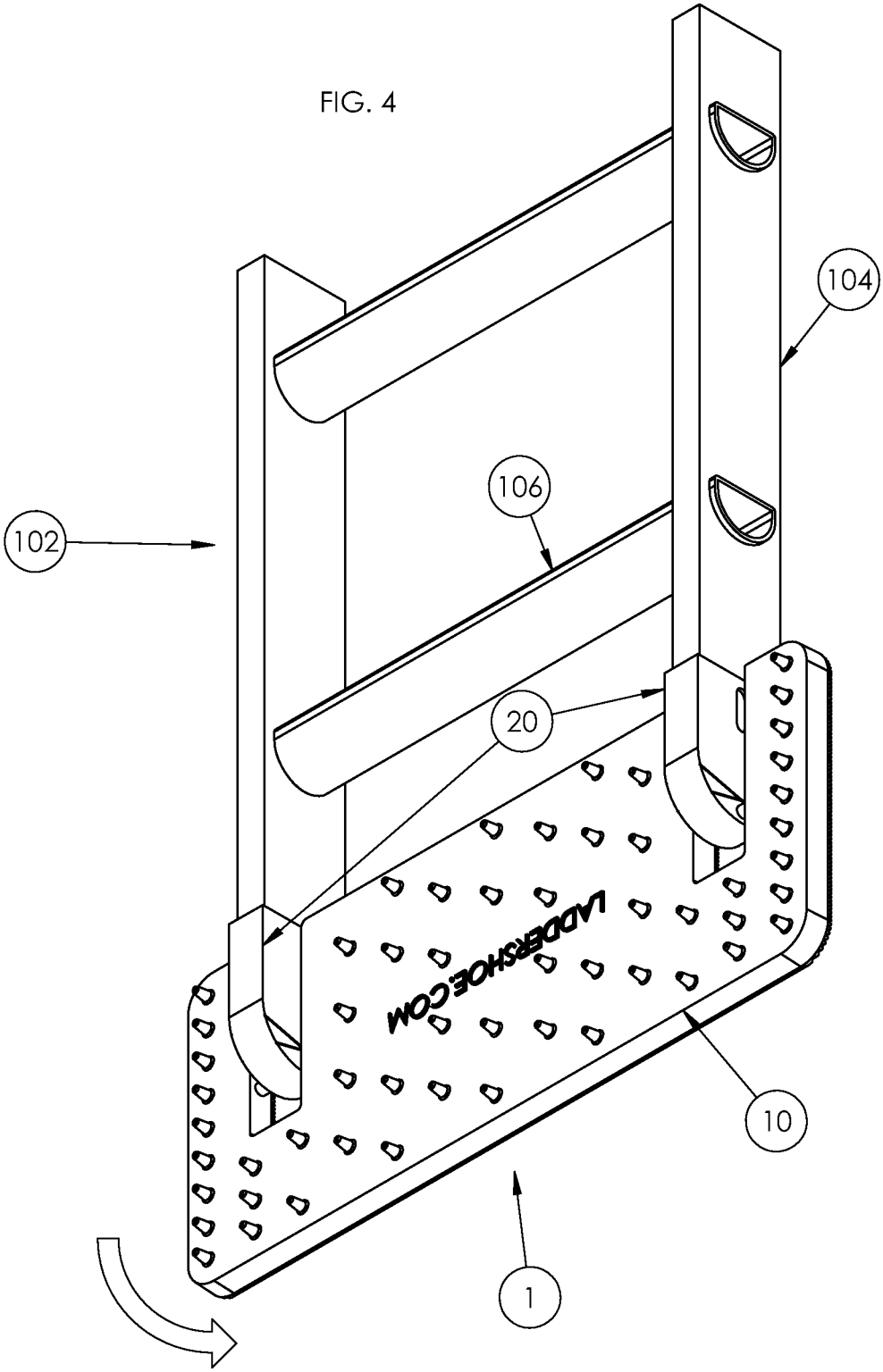
FIG. 4 is a bottom perspective view of the ladder base device of FIG. 1, the device being shown with a ladder mounted to it and while the platform element of the device is being rotated relative to the ladder.

Referring now to FIGS. 1 and 4, there is illustrated a preferred embodiment of the ladder base device 1 of the present invention with a ladder 102 mounted thereto. The present device 1 provides a base for a ladder 102 to be mounted upon for the purpose of inhibiting sliding movement of the ladder's rails 104 along the ground or a floor surface.

Generally speaking, when a ladder 102 is leaned against a vertical support (e.g., a vertical wall) and load is placed along its rungs 106 (e.g., the weight of a user), the rails 104 of the ladder 102 may be urged, by that load, to slide along the ground. If a base device is not being used, the frictional forces between the rails 104 and the ground surface that they are in direct contact with are overcome, the ladder 102 will slide along the ground—potentially causing catastrophe for the user. However, by mounting the ladder 102 atop the present base device 1, that potential is severely reduced.

The present base device 1 shown in the accompanying drawings comprises two main components, a platform 10 and a pair of ladder rail receptacles 20 that are pivotably connected by a rod 30. In a preferred embodiment, the platform 10 is a planar object that is generally rectangular and is longer in its lateral dimension (i.e., the direction of ladder rungs 106) than it is in its longitudinal dimension. In fact, the longitudinal width of the rectangular platform 10 ideally measures just short of twice the height of the lowest rung 106 along a ladder 102 to be mounted to the base device 1. Therefore, when the platform 10 is rotated and is momentarily co-planar with the ladder rails 104, as depicted in FIG. 4, the platform 10 freely circulates beneath that rung 106. Furthermore, two laterally spaced, longitudinally extending inlets are formed within one lateral edge 12 of the platform 10. The lateral width of each inlet is greater than the lateral width of a typical ladder rail 104—allowing the rails 104 passage through the platform 10 as the platform 10 is pivoted 180 degrees from one side 18 facing groundward to the other side 16 contacting the ground.

The platform 10 can be principally made of any of a variety of rigid materials, including various metals, woods, plastics and rubbers. In any case, the opposing platform faces 16, 18 have dramatically different surface topographies that are configured to reversibly engage different types of ground surfaces. The platform faces 16, 18 may even be fabricated of different materials. For example, in one embodiment, the platform 10 is fabricated of a high density polyethylene composition and is molded to have a first surface 16 with a series of ground spike protrusions along it that are efficacious for engaging and penetrating a grass, dirt, or mulch ground surface. Then, adhesively bonded to the platform's other surface 18 is a soft rubber corrugated mat 22 that is efficacious for frictionally engaging a wood or tile floor, for example.

In a preferred embodiment, each rail receptacle 20 has a rectangular tubular upper portion that forms a frictional, cap-like fit over the ends of a typical ladder rail 104, and it has a solid lower portion with a bore 26 through which the pivot rod 30 passes. The bottoms of the rail receptacles 20 are rounded to make them rockable along, the ground and accommodating of a range of ladder lean angles. The upper portion of the receptacles 20 are deep enough that ladder rails 104 remain securely housed within them throughout a wide range of ladder lean angles, even if the receptacles 20 do not frictionally fit onto the rails 104.

Finally, as can be gleaned from FIG. 4, the pivot rod 30 extends laterally through a bore 24 within the platform 10 and axially aligned holes 26 within both rail receptacles 20. In manufacturing a preferred embodiment of the platform 10, it is molded around the rod 30 so that the ends of the lateral bore 24 within the platform 10 keep the rod 30 contained within the platform 10.

Aspects of various embodiments of the present invention that are not recited above or claimed below may be noted from observing the illustrations included herein.

What is claimed is:

1. A ladder base device configured to support a ladder, having a pair of laterally-spaced rails, by inhibiting the ladder from sliding along a floor or ground surface and comprising:

a pair of ladder rail receptacles configured to have the ladder rails inserted thereinto; and a slip-inhibiting platform to which the rail receptacles are pivotally attached, wherein the platform has a first surface and an opposing second surface, and wherein the platform surfaces have respective surface areas that extend laterally beyond the laterally-spaced rail receptacles; and wherein the platform is pivotally mounted to the rail receptacles and is pivotable, relative the rail receptacles, between a first position in which the first surface is ground-facing and an opposing second position in which the second surface is ground-facing, wherein the platform has a generally rectangular profile having a pair of laterally-spaced, parallel and longitudinally-extending inlets formed therewithin, wherein the rail receptacles are positioned within the inlets, and wherein the inlets are configured such that when the ladder rails are inserted into the inlets and the platform is rotated 180 degrees relative to the inserted ladder rails, the ladder rails are passed unobstructed through the inlets.

2. The ladder base device of claim 1, wherein the range of pivot motion of said platform is at least 180 degrees.

3. The ladder base device of claim 1, wherein said rail receptacles are configured to envelop and form a friction fit around ends of the ladder rails.

4. The ladder base device of claim 1, wherein said first surface is configured for frictional engagement with a floor surface and said second surface is configured for penetrating engagement with a ground surface.

5. A ladder base device configured to support a ladder, having a pair of laterally-spaced rails, by inhibiting the ladder from sliding along a floor or ground surface and comprising:

a pair of ladder rail receptacles configured to have the ladder rails inserted thereinto; and a slip-inhibiting platform to which the rail receptacles are pivotally attached, wherein the platform has a first surface configured for frictional engagement with a floor surface and an opposing second surface that is configured for penetrating engagement with a ground surface, and wherein the platform surfaces have respective surface areas, for such floor or ground engagement, that extend laterally beyond the laterally-spaced rail receptacles; and wherein the platform is pivotally mounted to the rail receptacles and is pivotable, relative the rail receptacles, between a first position in which the first surface is ground-facing and an opposing second position in which the second surface is ground-facing, wherein the platform has a generally rectangular profile having a pair of laterally-spaced, parallel and longitudinally-extending inlets formed therewithin, wherein the rail receptacles are positioned within the inlets, and wherein the inlets are configured such that when the ladder rails are inserted into the inlets and the platform is rotated 180 degrees relative to the inserted ladder rails, the ladder rails are passed unobstructed through the inlets.

6. The ladder base device of claim 5, wherein the range of pivot motion of said platform is at least 180 degrees.

7. The ladder base device of claim 5, wherein said rail receptacles are configured to envelop and form a friction fit around ends of the ladder rails.

8. The ladder base device of claim 5, wherein said platform second surface has spikes for penetrating a ground surface formed therealong.

* * * * *